United States Patent [19]

Vrieze

[11] Patent Number: 4,636,686

[45] Date of Patent: Jan. 13, 1987

[54] LOW-PRESSURE MERCURY VAPOR DISCHARGE LAMP PROVIDED WITH AN AMALGAM FORMING ALLOY

[75] Inventor: Wubbe Vrieze, Eindhoven, Netherlands

[73] Assignee: U.S. Philips Corporation, New York, N.Y.

[21] Appl. No.: 705,931

[22] Filed: Feb. 26, 1985

[30] Foreign Application Priority Data

Mar. 9, 1984 [NL] Netherlands ..... 8400756

[51] Int. Cl.[4] ..... H01J 61/20

[52] U.S. Cl. ..... 313/565; 313/490; 313/639

[58] Field of Search ..... 313/490, 565, 639

[56] References Cited

U.S. PATENT DOCUMENTS 3,263,111 7/1966 Doering ..... 313/490

4,093,889 6/1978 Bloem et al. ..... 313/490 X

*Primary Examiner*—Palmer C. DeMeo

*Assistant Examiner*—K. Wieder

*Attorney, Agent, or Firm*—Norman N. Spain

[57] ABSTRACT

A low-pressure mercury vapor discharge lamp comprising a discharge vessel (2) which is sealed in a vacuum-tight manner and in which during operation of the lamp a discharge is present, while this discharge vessel contains a small quantity of an alloy (11) which forms with mercury an amalgam, which alloy is composed of bismuth, lead and silver.

5 Claims, 3 Drawing Figures

LOW-PRESSURE MERCURY VAPOR DISCHARGE LAMP PROVIDED WITH AN AMALGAM FORMING ALLOY

BACKGROUND OF THE INVENTION

The invention relates to a low-pressure mercury vapor discharge lamp comprising a discharge vessel which is sealed in a vacuum-tight manner and in which during operation of the lamp a discharge is present, while this discharge vessel contains a small quantity of an alloy which forms with mercury an amalgam. Such a lamp is known from U.S. Pat. No. 4,157,485 (PHN 8057).

In the known lamp, due to the presence of the amalgam in the discharge vessel, the mercury vapor pressure is stabilized during operation of the lamp at a value near $6.10^{-3}$ torr over a wide temperature interval. At such a value, the lamp has the highest efficiency of the conversion of electrical energy supplied to the lamp into ultraviolet radiation. If the energy supplied to the lamp strongly increases or if the lamp is operated at an area having a comparatively high ambient temperature (such as in given luminaires), the light output of the lamp hardly decreases. In the known lamp, the discharge vessel contains an alloy which forms with mercury an amalgam, such as an amalgam consisting of mercury, indium and bismuth.

Although a satisfactory vapor pressure stabilization is obtained in the discharge vessel with the amalgam mentioned in that patent over a wide temperature interval, it has been found that especially with lamps that can be comparatively heavily loaded and comprise a tubular discharge vessel of comparatively small diameter the stabilization value of the mercury vapor pressure during operation is too low to obtain an optimum efficiency and a highest possible light output. Moreover, it has been found that the mercury vapor pressure at a temperature in the discharge vessel at the area of the amalgam of 100° to 120° C. even falls below the first-mentioned value of $6.10^{-3}$ torr. This is disadvantageous especially with compact low-pressure discharge lamps in which the tubular discharge vessel is surrounded by a glass envelope and the temperature in the discharge vessel during operation lies just in this range.

BRIEF SUMMARY OF THE INVENTION

The invention has for its object to provide a low-pressure mercury vapor discharge lamp, which obviates the aforementioned disadvantages.

According to the invention, a low-pressure mercury vapor discharge lamp of the kind mentioned in the opening paragraph is is provided with an amalgam-forming alloy present in the discharge vessel which alloy is composed of bismuth, lead and silver.

Such an alloy forms with mercury an amalgam, by means of which during operation of the lamp the mercury vapor pressure is stabilized over a wide temperature interval on a value near $11.10^{-3}$ torr. It has been found that especially a lamp provided with a tubular discharge vessel having a comparatively small inner diameter (for example about 10 mm, such as a discharge tube of a compact low-pressure mercury vapor discharge lamp), has an optimum light output at this vapor pressure. It has further been found that the mercury vapor pressure in the discharge vessel has even at a comparatively low ambient temperature a value such that the lamp ignites readily. It has been found that the light output of the lamp according to the invention is at an optimum at a temperature at the area of the amalgam in the discharge vessel lying between about 70° C. and 150° C.

DETAILED DESCRIPTION OF THE INVENTION

The quantity of mercury which is present in the discharge vessel and which forms with the alloy an amalgam determines to a considerable extent the level at which the mercury vapor pressure is stabilized. Preferably, the ratio of the sum of the number of atoms of bismuth, lead and silver to the number of atoms of mercury lies between 94:6 and 99:1. It has been found that with an amalgam containing a higher percentage of mercury the level of stabilization of the mercury vapor pressure in the discharge vessel is rather high for an optimum efficiency. At a percentage of mercury less than 1%, there is a risk that no sufficient mercury vapor pressure stabilization is obtained, for example due to the fact that mercury is bonded to the wall of the discharge vessel.

It is possible to apply the amalgam as such in the discharge vessel. However, it is alternatively possible to apply the mercury and the amalgam-forming alloy as separate components. The mercury can then be metered with great accuracy (see, for example, GB-PS No. 1,267,175). The alloy of bismuth, lead and silver may then be located at a comparatively cool area in the discharge vessel. In a practical embodiment, the alloy is present on the inner wall of the exhaust tube which is in open communication with the space in the discharge vessel.

The invention may be used for different kinds of low-pressure mercury vapor discharge lamps. The invention may be used especially in the aforementioned compact low-pressure mercury vapor discharge lamps provided on one side with a cap and serving as an alternative to incandescent lamps for general illumination purposes. The invention may also be used advantageously for stabilizing the mercury vapor pressure in the discharge vessel of an electrodeless mercury discharge lamp.

Figure 1:
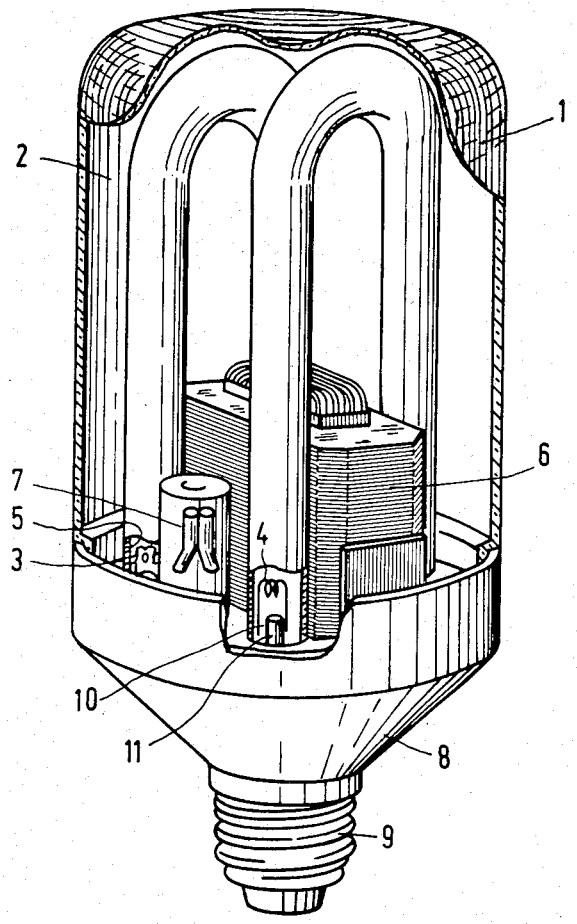
FIG. 1 of the drawing is a diagrammatic view of a lamp of the invention.

The lamp shown in FIG. 1 comprises a glass lamp envelope 1. The outer side of this envelope is provided with a pattern of ribs, as a result of which during operation the lamp has a homogeneous brightness. There is arranged within this envelope a tubular discharge vessel 2 which is sealed in a vacuum-tight manner and is bent into the shape of a hook. At the ends of the discharge vessel 2 there are provided electrodes 3 and 4, between which a discharge is maintained during operation of the lamp. The inner wall of the discharge vessel is coated with a luminescent layer 5. The lamp is further provided with an electrical stabilization ballast 6, a starter 7 and a conical lamp bowl 8 preferably consisting of synthetic material. The latter is provided at the neck with an Edison lamp cap 9 with which the lamp can be screwed into the fitting for an incandescent lamp.

Figure 3:
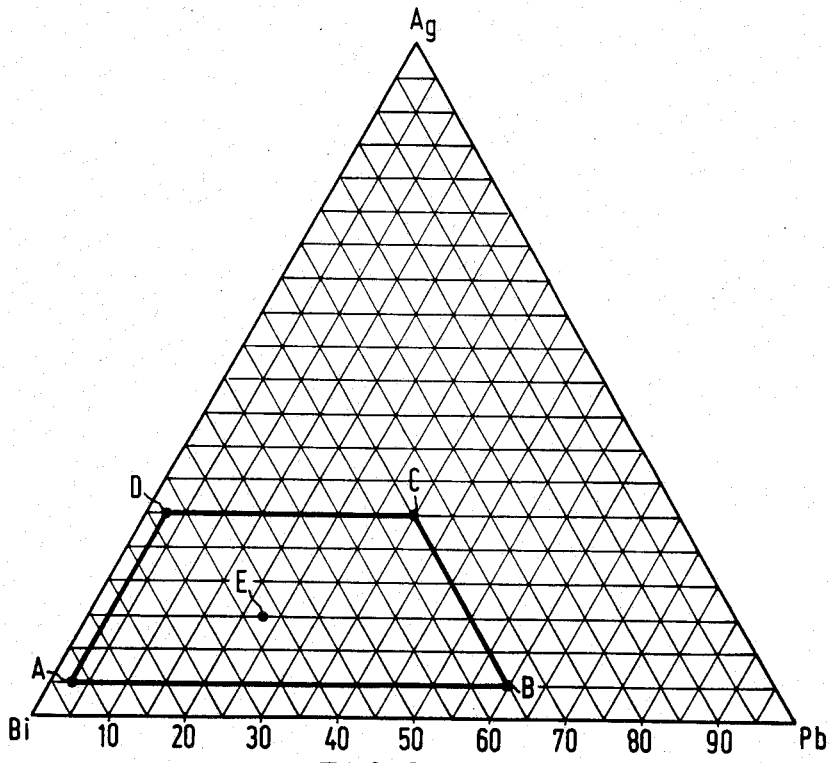
FIG. 3 is a ternary diagram of the composition Bi-Pb-Ag showing preferred compositions of the amalgam-forming alloy of the invention.

The inner wall of the exhaust tube 10 situated in the discharge vessel 2 is provided with a quantity of about 200 mg of an alloy 11 of bismuth, lead and silver. The ratio in atoms Bi:Pb:Ag preferably lies in a range which is indicated in the ternary diagram Bi-Pb-Ag (see FIG. 3) by a quadrangle ABCD with A: 93% of Bi, 2% of Pb and 5% of Ag; B: 35% of Bi, 60% of Pb and 5% of Ag; C: 35% of Bi, 35% of Pb and 30% of Ag; D: 68% of Bi, 2% of Pb and 30% of Ag (at. %). The light output is then high over a wide temperature range. In the instant practical embodiment, the ratio Bi:Pb:Ag is about 63:22:15 (also in atoms). This point is designated by E. The discharge vessel further contains 6 mg of mercury. The ratio of the sum of the number of atoms of bismuth, lead and silver to the number of atoms of mercury in the amalgam is then 93:3. Since the alloy is present at a cool area in the discharge vessel (in the exhaust tube), under operating conditions a favorable stabilization of the mercury vapor pressure in the discharge vessel is obtained.

Figure 2:
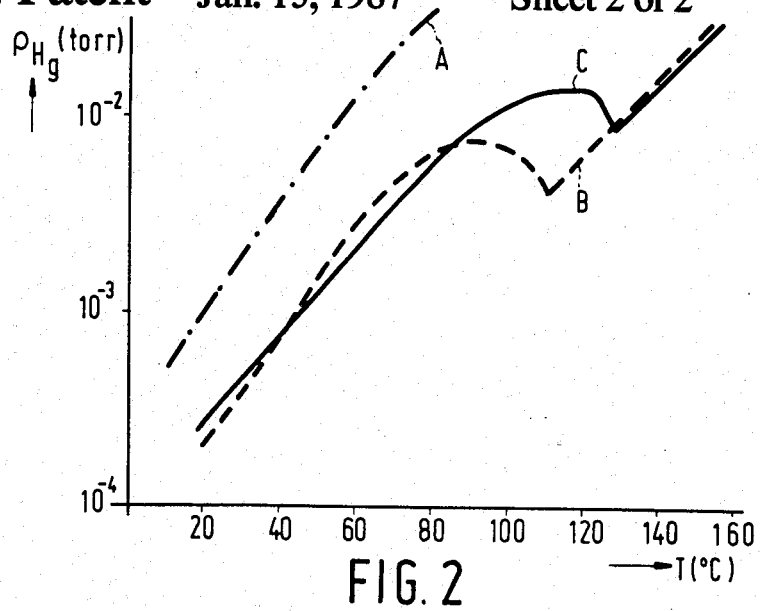
FIG. 2 is a graph showing the relation of mercury vapor pressure to temperature for mercury, for a prior art amalgam and for an amalgam of the invention.

In FIG. 2, the curve showing the variation of the mercury vapor pressure as a function of the temperature with pure mercury is indicated by A. The curve showing the mercury vapor pressure above an amalgam of bismuth, indium and mercury (as a function of the amalgam temperature) is indicated by B. The ratio in atoms of Bi:In:Hg was 51:46:3. The curve C finally shows such a variation of the mercury vapor pressure above an amalgam of the composition according to the invention. The ratio in atoms is Bi:Pb:Ag:Hg=53:24:20:3.

It appears from this graph that the mercury vapor pressure in a discharge vessel with an amalgam according to the invention (curve C) is stable over a wide temperature interval. The value of the mercury vapor pressure is then about $11.10^{-3}$ mm Hg. At this vapor pressure, a lamp comprising a discharge tube of a comparatively small diameter, as shown in FIG. 1, has an optimum light output. As compared with curve B, the said temperature interval is slightly shifted to the right and upwards. It further appears from the variation of curve C that at a temperature at the area of the amalgam of about 110° C. the mercury vapor pressure in the discharge vessel lies near the value of $11.10^{-3}$ torr. At this value of the vapor pressure, the light output of the lamp is as high as possible, It appears from the variation of curve B that the mercury vapor pressure is just comparatively low at 110° C., which results in a comparatively low light output. It further appears from the variation of curve C that at room temperature the mercury vapor pressure is slightly lower than the vapor pressure with pure mercury (curve A). A lamp according to the invention ignites readily. In order to further improve the ignition conduct, in an embodiment, an auxiliary amalgam is further provided in the immediate proximity of the coiled filament of the electrodes (not shown in the drawing). After the lamp has been switched on, the temperature of such an amalgam (consisting, for example, of indium and mercury) is directly influenced by the temperature of the electrode and substantially the whole quantity of mercury is rapidly selected from the auxiliary amalgam.

In a practical embodiment of the lamp released, the overall length of the tubular discharge vessel (2) was about 36 cm, while the inner diameter was about 10 mm. The amalgam 11 consisted of 200 mg of an alloy of bismuth, lead and silver (atomic ratio 55:25:20) and 6 mg of mercury.

The light output of the lamp was 600 lm, the discharge vessel further containing a quantity of argon (pressure 3 torr) and the inner wall being provided with a luminescent layer consisting of a mixture of two phosphors, i.e. green luminescent terbium-activated cerium magnesium aluminate and red luminescing yttrium oxide activated by trivalent europium. The power consumed by the lamp (inclusive of the ballast) was about 18 W (220 I V, AC).

What is claimed is:

1. A low-pressure mercury vapor discharge lamp comprising a discharge vessel which is sealed in a vacuum-tight manner and in which during operation of said lamp a discharge is present; and said discharge vessel contains a small quantity of an alloy which forms with mercury an amalgam, characterized in that the alloy is composed of bismuth, lead and silver.

2. A low-pressure mercury vapor discharge lamp as claimed in claim 1, characterized in that the ratio of the sum of the number of atoms of bismuth, lead and silver to the number of atoms of mercury lies between 94:6 and 99:1.

3. A low-pressure mercury vapor discharge lamp as claimed in claim 1, characterized in that the mutual ratio of the numbers of atoms of bismuth, lead and silver lies in the quadrangle ABCD of the ternary diagram Bi Pb-Ag with A: 93% of Bi, 2% of Pb, 5% of Ag; B: 35% of Bi, 60% of Pb and 5% of Ag; C: 35% of Bi, 35% of Pb, 30% of Ag; D: 68% of Bi, 2% of Pb, 30% of Ag (at. %).

4. A low-pressure mercury vapor discharge lamp as claimed in claim 1, characterized in that the ratio of the number of atoms of bismuth to the number of atoms of lead to the number of atoms of silver lies near the ratio 63:22:15.

5. A low-pressure mercury vapor discharge lamp as claimed in claim 1, characterized in that the amalgam-forming alloy is present on the inner wall of the exhaust tube.

* * * * *

UNITED STATES PATENT AND TRADEMARK OFFICE

CERTIFICATE OF CORRECTION

PATENT NO. : 4,636,686

DATED : January 13, 1987

INVENTOR(S) : WUBBE VRIEZE

It is certified that error appears in the above-identified patent and that said Letters Patent is hereby corrected as shown below:

In the Claims:

Column 4, line 53, change "the exhaust" to --an exhaust--.

Column 4, line 54, after "tube" insert --present in said lamp--.

Signed and Sealed this

Fifth Day of January, 1988

*Attest:*

DONALD J. QUIGG

*Attesting Officer*

*Commissioner of Patents and Trademarks*